United States Patent [19]

Forrest

[11] 4,012,246

[45] * Mar. 15, 1977

[54] SUPER FINE PETN THIN LAYER SLURRY EXPLOSIVE

[75] Inventor: Charles D. Forrest, Hollister, Calif.

[73] Assignee: Teledyne McCormick Selph, an operating division of Teledyne Industries, Inc., Hollister, Calif.

[ * ] Notice: The portion of the term of this patent subsequent to Oct. 14, 1992, has been disclaimed.

[22] Filed: Oct. 14, 1975 (Under Rule 47)

[21] Appl. No.: 622,319

Related U.S. Application Data

[63] Continuation-in-part of Ser. No. 434,754, Jan. 31, 1974, Pat. No. 3,912,560.

[52] U.S. Cl. ..... 149/47; 149/60; 149/62; 149/93

[51] Int. Cl.[2] ..... C01B 31/32; C01B 25/32

[58] Field of Search ..... 149/38, 47, 60, 62, 149/93

[56] References Cited

UNITED STATES PATENTS

| | | | |
|---|---|---|---|
| 3,457,128 | 7/1967 | Griffith et al. | 149/93 |
| 3,676,234 | 7/1972 | Schwoyer | 149/38 |
| 3,754,061 | 8/1973 | Forrest et al. | 149/93 X |
| 3,765,967 | 10/1973 | Funk et al. | 149/47 X |
| 3,912,560 | 10/1975 | Forrest | 149/93 X |

*Primary Examiner*—Edward A. Miller
*Attorney, Agent, or Firm*—David H. Semmes

[57] ABSTRACT

A cap-sensitive slurry explosive capable of propagating a high order detonation in thin layers and which has a high degree of safety for a cap-sensitive explosive. The slurry consists of a superfine grained explosive, suspended in an energetic, but non-self-explosive liquid matrix and contains no liquid explosive ingredient. The slurry resists dispersion in a variety of liquids including water and crude oil. In the preferred embodiments the slurries include penetaerythritol tetranitrate (PETN) in super fine particles, having an average particle size of 6.5 microns.

8 Claims, 1 Drawing Figure

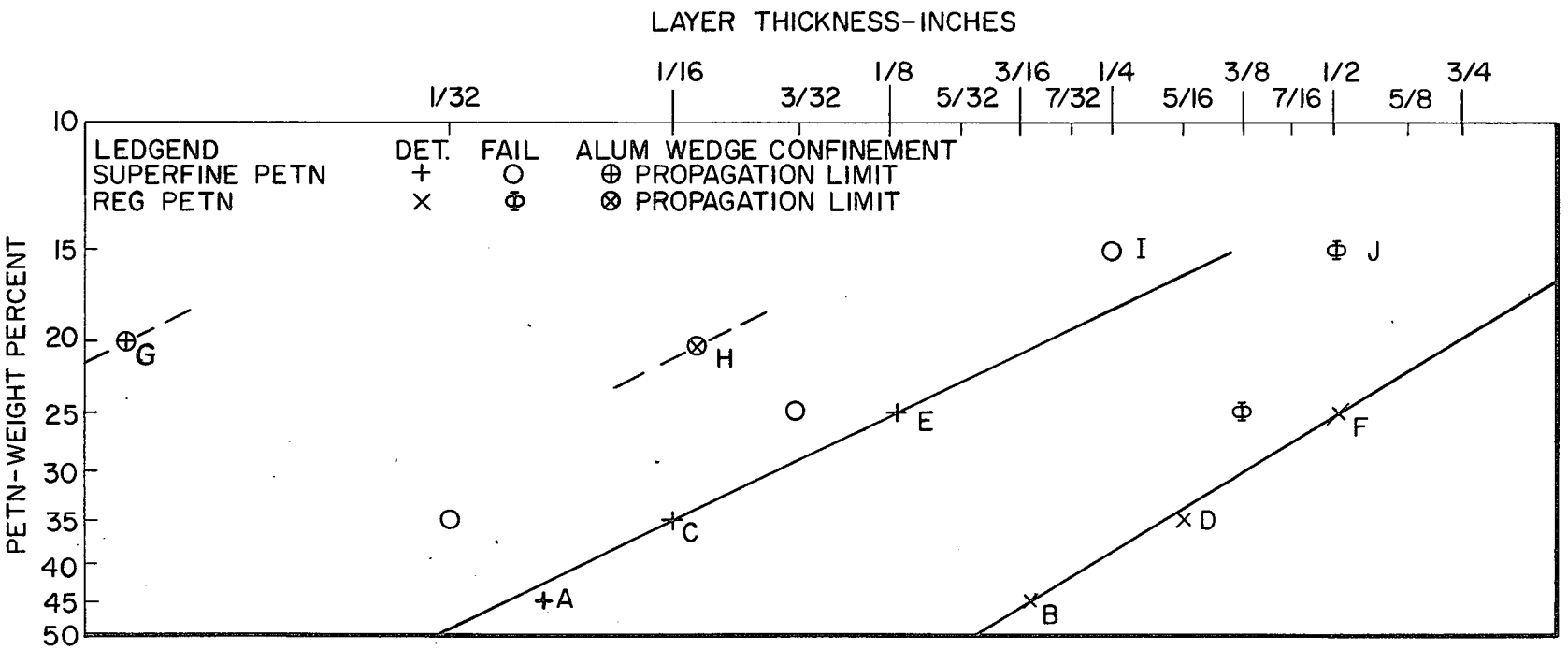
LAYER THICKNESS-INCHES
1/32
1/16
3/32
1/8
5/32
3/16
7/32
1/4
5/16
3/8
7/16
1/2
5/8
3/4
PETN-WEIGHT PERCENT
10
15
20
25
30
35
40
45
50
LEDGEND
SUPERFINE PETN
REG PETN
DET.
FAIL
ALUM WEDGE CONFINEMENT
PROPAGATION LIMIT
PROPAGATION LIMIT
A
B
C
D
E
F
G
H
I
J

SUPER FINE PETN THIN LAYER SLURRY EXPLOSIVE

CROSS-REFERENCE TO RELATED APPLICATIONS

This is a continuation-in-part of my application THIN LAYER PROPAGATING SLURRY EXPLOSIVE, filed Jan. 31, 1974, now U.S. Pat. No. 3,912,560, issued Oct. 14, 1975.

BACKGROUND OF THE INVENTION

As is known, certain explosives such as penetaerythritol tetranitrate (PETN) for example, are hazardous when subjected to modest physical abuse from impact or friction forces. Such compounds additionally do not have desired inertness toward crude oil and brine and dilute forms of many other well environmental material. Such materials additonally are hazardous in being highly inflammable and in many formulations are toxic.

BRIEF DESCRIPTION OF THE INVENTION

The slurry of the present invention is a new type of cap-sensitive slurry explosive capable of propagating a high order detonation in thin layers. The invention provides a safe explosive in slurry form which may be used in oil well and gas well formation fracturing, rock fracturing for in situ ore leaching, non-nuclear fracturing of oil shale formations, and explosive formation of fire lanes in terrain inaccessible to motorized equipment.

The slurry of the present invention is formulated to resist accidental initiation by adiabatic compression of gas bubbles which may be introduced during loading and handling, and due to the good chemical stability of the explosive formula, the slurry gives a high degree of inertness toward crude oil and brine and dilute forms of most other well environmental materials. The material of the present invention in fires is difficult to ignite, and once ignited, burns quietly with no explosion. The ingredients comprising the slurry are non-toxic prior to detonation.

According to the instant invention there is disclosed a relationship between the composition of a slurry comprising superfine particles of PETN in the slurry as compared and contrasted to a completely analogous slurry comprised of fine particle PETN, as is conventionally available. According to the particular improvements taught herein, a study was conducted to clearly differentiate the performance characteristics between superfine PETN and regular PETN to obtain the effect of using PETN explosive which has an average particle size of approximately 6.5 microns. As is taught herein, both sets of formulations are made with identical ingredients and mixed in identical procedures except for the type of PETN used. As used herein, regular PETN can be described as that available in military grade, Class IV, having a particle size by test on screens as follows:

| Screen Test | |
|---|---|
| On 50 U.S. Std., | 1.6 percent |
| On 100 U.S. Std., | 20.9 percent cumulative |
| On 200 U.S. Std., | 61.9 percent cumulative |

In distinction, the superfine PETN used in the instant slurry compositions for contrast with the regular PETN has an average particle size of 6.5 microns in diameter. Such superfine PETN is available from such manufacturers as DuPont, and will hereinafter be referred to as superfine PETN.

It has been found that by employing superfine PETN in the slurry formulations, the propagating thickness is from three to six times smaller than that obtainable with a slurry using regular PETN as a constituent part. This decrease in thin layer propagating thickness is particularly advantageous in applications of oil and gas well stimulation, solution mining, coal and oil shale fracturing and any other application seeking successful explosive stimulation with very thin layers of explosive slurries.

BRIEF DESCRIPTION OF THE DRAWING

FIG. 1 is schematic representation of the propagation layer thickness versus PETN content for formulations using both the regular and superfine PETN explosive.

DESCRIPTION OF THE PREFERRED EMBODIMENTS

In order to correlate the reduction in slurry thickness that could be achieved with the superfine PETN substitution for regular fine particle PETN, the following mixtures were prepared:

| MIX NO. | | A | B | C | D | E | F | G | H | I | J |
|---|---|---|---|---|---|---|---|---|---|---|---|
| Superfine PETN (Wt) | % | 45 | | 35 | | 25 | | 20 | | 15 | |
| Regular PETN | % | | 45 | | 35 | | 25 | | 20 | | 15 |
| Ammonium Nitrate | % | 27 | 27 | 33 | 33 | 39 | 39 | 42 | 42 | 45 | 45 |
| Water | % | 18 | 18 | 22 | 22 | 26 | 26 | 28 | 28 | 30 | 30 |
| Diethylene Glycol | % | 9.5 | 9.5 | 9.4 | 9.4 | 9.4 | 9.4 | 9.3 | 9.3 | 9.3 | 9.3 |
| Jaguar HP-8 (GuarGum) | % | 0.5 | 0.5 | 0.6 | 0.6 | 0.6 | 0.6 | 0.7 | 0.7 | 0.7 | 0.7 |

The formulations were detonated on test fixtures which were the same for both the superfine and the regular PETN slurries. Since the only purpose of this test was to determine the propagation layer thickness versus the PETN content, as between the regular and superfine PETN, the results shown in FIG. 1 are illustrated for comparison purposes only and not as absolute values for propagation layer thicknesses.

As illustrated in FIG. 1 the uniform detonation, for example, of 25 percent superfine PETN slurry was 0.125 inches while an exactly analogous slurry with larger size particle PETN exhibited a uniform detonation layer thickness of .500 inches. As can be seen readily from inspection of FIG. 1, which is a logarithmic plot of propagation layer thickness versus PETN content for the two categories of PETN, the fine particle PETN slurries represented a uniform detonation layer thickness as shown by lines B, D and F in one test fixture, while the superfine particle PETN slurries exhibited a minimum uniform detonation layer thickness as represented by lines A, C and E.

The formulations A, C, and E were tested on a fixture known as a Benelex 41 in a uniform layer with the fixture having a masonite confining layer. The slurries G and H were tested with an aluminum confinement. The tapered aluminum wedges for compositons G and H were 2½ inches wide provided for an explosive 2½ inches wide by 20 inches long. The wedge was constructed of 6061-T6 aluminum with a milled slot tapered uniformly over the 20 inch length, the aluminum being approximately ¾ inch thick on the bottom and the sides with a ¼ inch aluminum top cover. The slurry formulations were detonated with a number 6 aluminum blasting cap, readily available from DuPont, together with a 7.2 gm sheet explasine primer.

With the wedge configuration the slurry comprising 20 percent of a superfine PETN exhibited a propagation of 0.011 inches while the same composition with regular fine PETN exhibited a propagation limit of .068 inches. Therefore, as can be seen from an inspection of the data points of FIG. 1, the employment of a superfine PETN, having an average particle size of 6.5 microns, resulted in a propagating thickness from three to six times smaller than that obtainable with the regular PETN.

In preparing the formulations, the approximate weight percentages also included a minute amount of a cross-linking agent. A satisfactory cross-linking agent was found to be TYZOR LA, a trademark product of the E. I. DuPont de Nemours and Company, Inc. which is generically known as titanium-antimonium lactate. A ten percent solution of this cross-linking agent was added in the concentration of five drops per 100 gram of slurry just prior to loading into the test assembly. Additionally, the mixtures G and H were partly settled and stirred just prior to the cross-linking operation. In the above examples, the concentration of the ammonium nitrate solution is not critical. A 60 percent solution is convenient to use because the ammonium nitrate stays completely in solution above 54° F, which means that handling is simplified over, for example, an 80 percent solution which has a solidification temperature of about 136° F; thus requiring expensive heated storage. After blending with any well-known type of liquid anti-freeze agent, such as diethylene glycol, the solidification temperature is decreased. As shown in the above mixes, the sample weight percentages for each individual constituent part are as shown.

These formulations are then cap-sensitive explosives capable of propagating a high order detonation in thin layers, i.e. 1/32 of an inch when confined between masonite. More significantly, there is shown herein a relationship between the use of superfine particle PETN, where the 6.5 mircon diameter particles allow for reduction of three to six times in the thin layer propagation layer thickness as a function of PETN content. These formulations are able to detonate completely in thin layers at temperatures of approximately 200° F, while simultaneously exposed to a hydrostatic pressure of 10,000 psi or above and do not cause handling problems since there is no liquid explosive ingredient. It has been found that the slurry explosives are not detonated by British 303 ammunition from a distance of 75 to 100 feet, even when back by steel or aluminum. Such slurry explosives will slowly decompose in a bon fire when unconfined, but by themselves will not support combustion. Therefore, the purpose of this invention is to teach a relationship between the use of extremely small particle PETN for the reduction of detonating layer thicknesses for particular applications. This control of detonation layer thickness as a function of the composition constituents allows the explosive to be tailored to explosive fracturing of oil and gas reservoirs in order to increase formation permeability and other such controlled applications. In such applications it is critical that the explosive propagate in thin layers to be effective for stimulating oil and gas wells, solution lining and coal and oil shale fracturing operations.

Ordinarily PETN (penethaerythritol tetranitrate) is considered a hazardous explosive which is known to explode when subjected to modest physical abuse from impact or friction forces. For example, in a test apparatus a small (approximately 1/20 of a gram) sample of sensitized small particle PETN when placed on a hard tool steel anvil and impacted by a free fall hammer (of hard tool steel and weighing 2.143 kg), a detonation of the PETN will occur when the drop of the hammer is only 2 cm. In other words, the impact sensitivity of the pure dry PETN is 4.3 kg—cm. However, when this same PETN is compound into a slurry explosive form where the PETN comprises upwards to 45 percent of the total weight of the mixture, the resulting explosive mixtures as shown herein are unaffected by repeated hammer drops, even from a drop height of 63.5 centimeters. Thus, in slurry form PETN has been found to be not exploded by an impact of 136.3 kg—cm. This is more than thirty times the energy at which the PETN alone explodes. As taught herein, by particularly using a slurry wherein the PETN particles have an average diameter of 6.5 microns, the advantages of a slurry can be further maximized for very thin layer applications. It has been found that the diameter of the PETN can be shown to have a significant effect on the propagation thickness of the slurry. As particularly illustrated in FIG. 1, for the same composition the use of PETN particles having such an average diameter such as 6.5 microns results in a three to six times reduction in the propagating layer thickness. As has also been shown, this reduction in thickness of the layer capable of supporting detonation occurs over a wide range of formulations, anywhere from 15 to 50 percent by weight of PETN in slurries.

The sensitized superfine PETN of 6.5 micron particle size as employed herein may be made according to the method taught in my copending application Ser. No. 434,753, filed Jan. 31, 1974. It is presently believed that superfine PETN comprises crystallites containing numerous voids or crystal irregularities, with these voids defining a sealed gas phase, possibly air. It is further believed that, upon detonation of this sensitized material, the passage of a shock wave through each superfine PETN particle effectively adiabatically compresses the gas in these void spaces. The net result is a tremendous increase in temperature and energy at each of the void sites which, with a speed allowed by physical law, pumps heat energy into the detonation reaction zone. This increased energy, in turn, serves to shorten the Chapman-Jouget detonation plane, and thus reduce high order detonation.

Within these slurries it is contemplated that the ammonium nitrate may be replaced by any of potassium, barium and sodium nitrate, and diethylene glycol may be substituted by formamide, diethyl formamide or other glycols and alcohols. Further the guar gum or Jaguar HP-8 may be replaced by polyacrylamide.

Manifestly, minor changes can be effected in the above described compositions without departing from the spirit and scope of the invention as defined and are limited solely by the appended claims.

I claim:

1. An improved slurry explosive able to propagate in very thin layers comprising a mixture of, by weight:

A. approximately 15% to 45% by weight of sensitized superfine particle penetaerythritol tetranitrate (PETN), said sensitized particles having an average diameter of approximately 6.5 microns and further comprising interstiticial voids defining a gas phase; and, B. approximately 45% to 27% by weight of a material selected from the group consisting of ammonium nitrate, potassium, barium and sodium nitrate; and C. approximately 10% by weight of a liquid anti-freeze agent; and D. approximately 0.5% to 0.7% of a material selected from the group consisting of guar gum and polyacrylamide; and E. a cross-linking agent; and F. water.

2. An improved slurry explosive as in claim 1, wherein said mixture comprises by weight:

A. 45% of said sensitized superfine PETN; and

B. 27 % of said material selected from the group consisting of ammonium nitrate, potassium, barium and sodium nitrate.

3. An improved slurry explosive as in claim 1, wherein said mixture comprises by weight:

A. 35% of said sensitized superfine PETN; and

B. 33% of said material selected from the group consisting of ammonium nitrate, potassium, barium and sodium nitrate.

4. An improved slurry explosive as in claim 1, wherein said mixture comprises by weight:

A. 25% of said sensitized superfine PETN; and

B. 39% of said material selected from the group consisting of ammonium nitrate, potassium, barium and sodium nitrate.

5. An improved slurry explosive as in claim 1, wherein said mixture comprises by weight:

A. 20% of said sensitized superfine PETN; and

B. 42% of said material selected from the group consisting of ammonium nitrate, potassium, barium and sodium nitrate.

6. An improved slurry explosive as in claim 1, wherein said mixture comprises by weight:

A. 15% of said sensitized superfine PETN; and

B. 45% of said material selected from the group consisting of ammonium nitrate, potassium, barium and sodium nitrate.

7. An improved slurry explosive as in claim 1, wherein said mixture comprises by weight, five drops per 100 grams of slurry of a 50% solution of titanium and antimonium lactate as said cross-linking agent.

8. An improved slurry explosive as in claim 1, wherein said liquid anti-freeze agent is selected from the group consisting of diethylene glycol, formamide and dimethyl formamide.

* * * * *